US005653217A

United States Patent [19]

Keller

[11] Patent Number: 5,653,217

[45] Date of Patent: Aug. 5, 1997

[54] BOW SIGHT

[76] Inventor: Thomas M. Keller, 1213 Plylant Crossings SW., Thomson, Ga. 30824

[21] Appl. No.: 539,297

[22] Filed: Oct. 4, 1995

[51] Int. Cl.[6] ..... F41G 1/467

[52] U.S. Cl. ..... 124/87; 33/285

[58] Field of Search ..... 124/87; 33/265

[56] References Cited

U.S. PATENT DOCUMENTS

| | | | |
|---|---|---|---|
| 2,959,860 | 11/1960 | Kowalcyk | 33/265 |
| 2,982,026 | 5/1961 | Peterson | 33/265 |
| 4,120,096 | 10/1978 | Keller | 33/265 |
| 4,170,071 | 10/1979 | Mann et al. | 33/265 |
| 4,215,484 | 8/1980 | Lauffenburger | 33/265 |
| 4,220,983 | 9/1980 | Schroeder | 362/114 |
| 4,521,972 | 6/1985 | Larson | 33/265 |
| 4,910,874 | 3/1990 | Busch | 33/265 |
| 4,915,088 | 4/1990 | Powers | 124/87 |
| 4,977,678 | 12/1990 | Sears | 33/265 |
| 5,025,565 | 6/1991 | Stenerson et al. | 33/265 |
| 5,048,193 | 9/1991 | Hacquet | 33/265 |
| 5,305,728 | 4/1994 | Young et al. | 124/87 |
| 5,339,227 | 8/1994 | Jones | 362/109 |
| 5,341,791 | 8/1994 | Shafer | 124/87 |
| 5,375,047 | 12/1994 | Mueller | 362/253 |
| 5,413,084 | 5/1995 | Haggaro | 124/87 X |

*Primary Examiner*—John A. Ricci
*Attorney, Agent, or Firm*—Maria Reichmanis

[57] ABSTRACT

A bow sight apparatus, including a housing with a front sight and a back sight mounted therein, means for illuminating the interior of the housing, and means for attaching the housing to a bow frame. The back sight is an elongated rod having a generally "V"-shaped notch formed at one end thereof; the front sight is an elongated rod having one or more sighting balls mounted thereon. In use, the bow sight is mounted to the bow frame, and its vertical and lateral positions adjusted to suit the user. The light is used to illuminate the interior of the housing under low ambient light conditions; red light is preferred so as not to alert game.

20 Claims, 2 Drawing Sheets

BOW SIGHT

BACKGROUND OF THE INVENTION

1. Field of the Invention

The present invention relates to sighting apparatus for use with archery bows. In particular, the present invention relates to a quick-aiming bow sight having front and rear sights mounted in a housing.

2. Discussion of Background

Whether engaged in hunting, competition shooting or recreational shooting, archers frequently use bow sights to improve the accuracy of their aim. Many presently-available bow sights include notched back sights and ball front sights (for example, Kowalcyk, U.S. Pat. No. 2,959,860; Young, et al., U.S. Pat. No. 5,305,728). However, other devices such as peep sights (Jones, U.S. Pat. No. 5,339,227), slots (Larson, U.S. Pat. No. 4,521,972) and sighting rings (Schroeder, U.S. Pat. No. 4,220,983) are also known. (As used herein, the terms "back sight" and "rear sight" refer to the sight closest to the archer when he aims the bow; the terms "fore sight" and "front sight" refer to the sight farthest away from the archer; the term "range" means the distance between the archer and the target.)

A number of bow sights have two or more front sights that can be adjusted for shooting at different ranges (Hacquet, U.S. Pat. No. 5,048,193; Sears, U.S. Pat. No. 4,977,678; Powers, U.S. Pat. No. 4,915,088; Lauffenburger, U.S. Pat. No. 4,215,484; Mann, et al., U.S. Pat. No. 4,170,071; Peterson, U.S. Pat. No. 2,982,026). These can be colored differently to aid the archer in selecting the correct sight for the desired range (Mueller, U.S. Pat. No. 5,375,047).

Various types of adjustments are available to adjust a bow sight to fit an individual archer. Typically, a bow sight can be moved up, down, or laterally with respect to the plane of the bow frame in order to position the sights to suit the individual and improve shooting accuracy. By way of example, Kowalcyk (U.S. Pat. No. 2,959,860) teaches front and back sights secured to a pivotable plate, and a mounting bracket that can be adjusted upwards and downwards to suit the user. Peterson (U.S. Pat. No. 2,982,026) discloses a device that includes an anchor plate for mounting to the bow. The plate, which carries two aligned peep sights, has two arcuate slots, one for rocking the plate back and forth on the bow and the other for mounting a slide.

Pendulum-type devices, such as those disclosed by Hacquet (U.S. Pat. No. 5,048,193) and Keller (U.S. Pat. No. 4,120,096) have pivotable sights that remain substantially vertical as the bow is tilted from true vertical. Hacquet's device has at least one adjustable front sight and a pivotable rear sight mounted on a pendulum. The pendulum pivots to remain vertical as the bow is tilted from true vertical.

Some bow sights are illuminated for use in low ambient light conditions. Thus, Lauffenburger (U.S. Pat. No. 4,215,484) positions a small incandescent sighting bulb at the upper end of a sight post; Mann, et at. (U.S. Pat. No. U.S. Pat. No. 4,170,071) teaches mounting light emitting diodes at the ends of the sighting balls; Jones (U.S. Pat. No. 5,339,227) uses a focused, battery-powered light to illuminate the aiming mark and level of a telescopic scope; and Schroeder (U.S. Pat. No. 4,220,983) places a battery-powered light-emitting diode in a sighting ring.

Many presently-available bow sights, while improving accuracy in shooting, have complex and delicate mechanisms that do not hold up well when subjected to the rigors of field use. Furthermore, many bow sights need to be adjusted whenever the archer shoots at a different range. Despite the many different types of bow sight available to archers, there is a need for an easy-to-use bow sight that, once adjusted for the individual archer, can be used for shooting arrows at different ranges without the need of further adjustments to the bow sight itself. The bow sight should be rugged, simple and economical to manufacture, easy to adjust, provide a clear view of the target, and be operable in low-light conditions.

SUMMARY OF THE INVENTION

According to its major aspects and broadly stated, the present invention is a bow sight apparatus including a housing with opposing open ends, front and back sights mounted inside the housing, means for illuminating the interior of the housing, and user-adjustable means for attaching the housing to a bow frame. The apparatus is simple and accurate to use, and readily adjustable to fit an individual archer's physique and preferred shooting style.

The front sight and the back sight constitute an important feature of the present invention. In a preferred embodiment of the invention, the back sight has a generally "V"-shaped notch at one end; the front sight has at least one sighting ball for sighting on targets at a predetermined range, and preferably at least two balls in aligned vertical relationship, each ball used for sighting on targets within a different preselected range. That is, for targets within a first range, the archer sights along a line between the notch and a first sighting ball; for targets within a second range, he or she sights along a line between the notch and a second sighting ball. Unlike prior art devices, a front sight according to the invention enables the archer to shoot arrows at targets within different ranges without stopping to adjust the sight.

Another feature of the present invention is the housing which encloses the front and back sights. The housing assists the archer to concentrate on the target by helping block out visual distractions. If desired, the housing may have a plurality of holes formed therethrough to admit light into the interior and thereby facilitate viewing of the sights.

Still another feature of the present invention is the illuminating means. The apparatus may includes a battery-powered light source that is operable to illuminate the interior of the housing for better viewing of the front and back sights under low ambient light conditions (dusk, dawn, night, deep woods, etc.). Red light is preferred, since red light does not affect the dark-adaptation of human vision as much as white light does; furthermore, red light does not disturb game. In addition, red light is visible to humans at night, and therefore may serve to alert others to a hunter's presence.

Another feature of the present invention is the attaching means. The housing is slidably fastened to a mounting plate, which in turn is attached to the frame of a bow. The vertical and lateral positions of the housing with respect to the frame can readily be adjusted to suit the individual archer. Once adjusted, no further adjustments—that might take time and thereby result in the archer's losing the chance to make a good shot—need be made. Once the apparatus is adjusted to his satisfaction, the archer need only aim and shoot.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
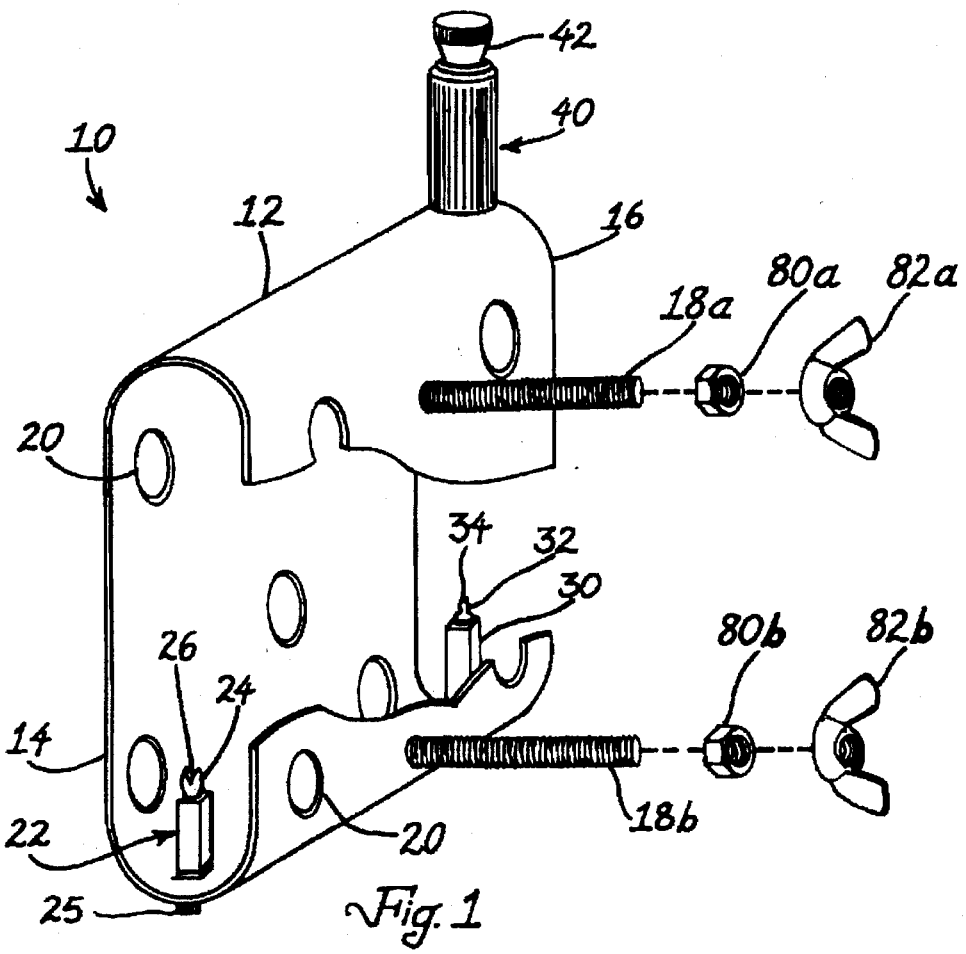
FIG. 1 is a perspective, partially cut-away view of a bow sight according to a preferred embodiment of the present invention.

In the following description, like reference numerals are intended to identify the same structural elements, portions or surfaces consistently throughout the several drawing figures, as such elements, portions or surfaces may be further described or explained by the entire written specification. As used in the following description, the terms "horizontal," "lateral," "vertical," "left," "right," "up," "down," etc. refer to the relative orientation of the illustrated structure as the particular drawing figure faces the reader. The direction which is toward the target in shooting will be termed the "front" and the direction which is away from the target will be called the "rear" or "back."

Figure 2:
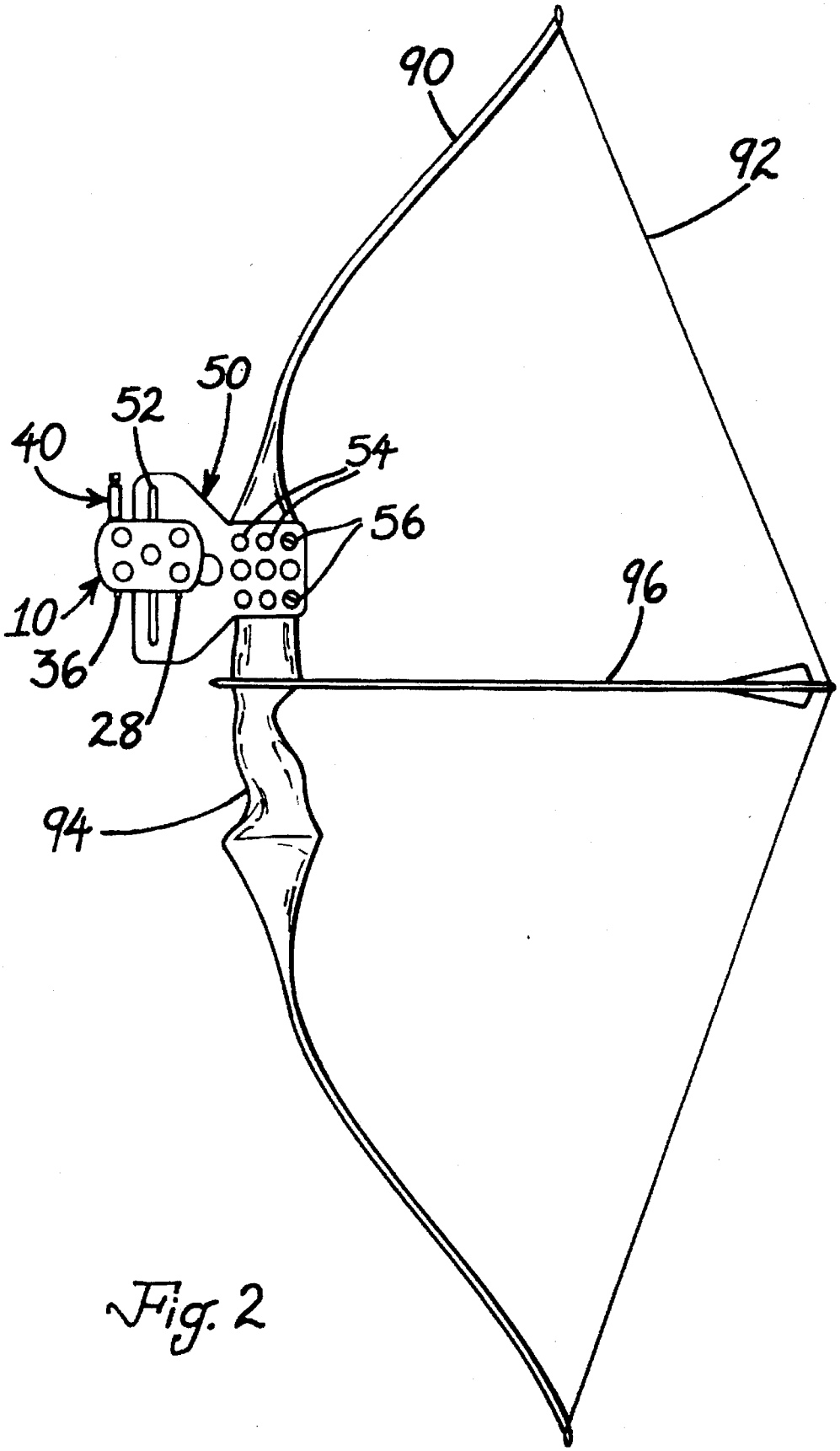
FIG. 2 shows the bow sight of FIG. 1 mounted to an archery bow.

Referring now to FIGS. 1 and 2, there is shown a preferred embodiment of a bow sight apparatus according to the present invention. Bow sight apparatus 10 includes a housing 12 having a first, or back end 14 and a second, or front end 16. Housing 12 may be approximately oval in shape with spaced-apart lateral side walls as shown in FIG. 1, or some other shape if desired. Threaded rods 18*a*, 18*b* extend from housing 12, substantially as shown. Housing 12 may include one or more throughholes 20, for admitting light into the interior of the housing.

A back sight 22 and a front sight 30 are mounted inside housing 12. Back sight 22 is formed as an elongated rod, terminating in a post 24 wherein is formed an approximately "V"-shaped sighting notch 26. Back sight 22 is positioned in the interior of housing 12 near first end 14. Front sight 30 is formed as an elongated rod, terminating in a post 32 and a sighting ball 34. Front sight 30 is positioned in the interior of housing 12 near second end 16, and aligned with back sight 22. If desired, posts 24, 32 may be integrally formed with rods 22, 30, respectively. Alternatively, posts 24, 32 may be made separately and attached to rods 22, 30 by some convenient means.

Back sight 22 and front sight 30 are attached to housing 12 by any convenient means. By way of example, sights 22, 30 may extend though holes in the bottom of housing 12, and be secured in position by nuts 28, 36, respectively (FIG. 2).

A typical bow 90 includes a bowstring 92 and a frame 94, and is used to draw and shoot an arrow 96 (FIG. 2). In use, housing 12 is attached to a mounting plate 50, which in turn is attached to frame 94. Mounting plate 50 is a generally flat plate having a slot 52 and a plurality of holes 54 formed therethrough. Mounting plate 50 may be attached to frame 94 by fasteners of any convenient type, such as a plurality of screws or bolts 56 extending through selected holes 54. It should be understood that other attachment means, including rivets, adhesives, and so forth, may be used to secure mounting plate 50 to frame 94.

Rods 18*a*, 18*b* extend through slot 52 and are secured to plate 50 by means of bolts 80*a*, 80*b* positioned on one side of plate 50 and wing nuts 82*a*, 82*b* positioned on the other side of the plate. As will be evident, the vertical position of housing 12 with respect to frame 94 may be adjusted by loosening wing nuts 82*a*, 82*b*, sliding the housing to the desired position along slot 52, and tightening the wing nuts. Similarly, the lateral position of housing 12 may be adjusted by adjusting the lateral position of bolts 80*a*, 80*b* on rods 18*a*, 18*b*, respectively. If desired, slot 52 may be marked with a series of gradations (not shown) to assist the archer in positioning housing 12.

Figure 3:
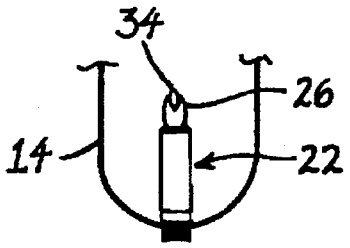
FIG. 3 is a plan view of the front and back sights shown in FIG. 1.
Figure 4A:
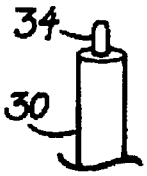
FIG. 4A shows a front sight according to a preferred embodiment of the present invention.
Figure 4C:
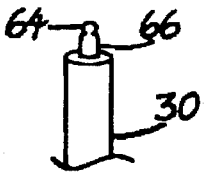
FIG. 4C shows a dual front sight according to a preferred embodiment of the present invention.
Figure 4B:
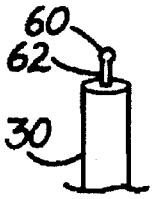
FIG. 4B shows a front sight according to another preferred embodiment of the present invention.

As noted above, sights 22 and 30 are aligned so that notch 26 and sighting ball 34 define a line of sight for aiming at a target (FIG. 3). Ball 34 maybe rounded or partial-spherical in form as shown in FIG. 3. Thus, ball 34 may be a rod with a hemispherical top attached to (or integrally formed with) elongated rod 30 (FIG. 4A). Alternatively, ball 34 may be replaced by a ball 60 atop a rod 62 (FIG. 4B). However, other shapes of ball 34, including but not limited to cubical, pyramidal and other straight-sided shapes, may also be useful.

When attached to a bow sight and mounted to a bow, a single front sight is usable for shooting at targets within a preselected range. For example, the sight may be adequate for targets within a range of approximately 10–20 yards (about 9–18 m) and optimal for targets within a range of approximately 14–16 yards (about 16–20 m). For targets outside this range, the archer must adjust the position of the sight for the desired range, or, for bow sight apparatus having a plurality of front pin sights, select a different sight for use. When hunting deer or other game, the archer may lose the chance for a good shot due to the extra time needed to adjust the sight or select the correct pin.

In another preferred embodiment of the invention, from sight 30 is adapted for sighting on targets in at least two different preselected ranges. Front sight 30 may terminate in a rod 66, such as a rounded cylinder, carrying a sighting ball 64. The upper end of rod 66 is used for sighting at targets within a first preselected range, whereas ball 64 is used for sighting at targets within a second preselected range. For example, ball 64 may be dimensioned and positioned for sighting at ranges within about 10–20 yards (approximately 9–18 m), and rod 66, for ranges within about 20–30 yards (approximately 18–27 m). Ball 64 preferably has a smaller diameter than rod 66, to assist the user in sighting and aiming at targets within different ranges.

Figure 5:
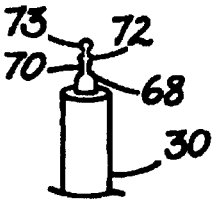
FIG. 5 shows a dual front sight according to still another preferred embodiment of the present invention.
Figure 4D:
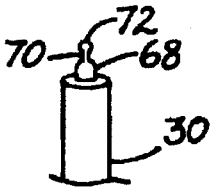
FIG. 4D shows a dual front sight according to another preferred embodiment of the present invention.

Alternatively, front sight 30 may include a rounded rod 68 (similar to sighting ball 34), and a narrower rod 70 which terminates in a ball 72 (FIG. 4D). In this embodiment of the invention, rod 68 is dimensioned for a first range and ball 72 for a second range. If desired, front sight 30 may have a plurality of such sighting balls. By way of example, a third ball 73 may be positioned and dimensioned for sighting at targets 30 yards (about 27 m) or more distant (FIG. 5). It will now be evident that other configurations are possible without departing from the spirit of the present invention.

As for above-described ball 34, balls 60, 64, 72 and rods 62, 68 may be rounded in form, rectangular, pyramidal, or some other convenient shape. The dimensions of balls 34, 60, 64, 72, rods 62, 66, 68, and notch 26 depend on such factors as the desired range for each ball, the dimensions of housing 10, and the distance between front sight 30 and back sight 22. In a preferred embodiment of the invention, ball 34 need be no wider than approximately 0.04–0.08" (about 1–2 mm), and from sight 30 and back sight 22 are approximately 2–3" (about 5–8 cm) apart. However, different dimensions may also be useful for the practice of the invention. The optimum dimensions of these and other components of bow sight 10 are best determined by a modest amount of experimentation and observation for each particular application.

As noted above, housing 12 may have a plurality of holes 20 formed therethrough, to admit light into the interior of the housing to facilitate viewing of sights 22, 30. Housing 12 may include a light housing 40 and a manually-actuated switch 42. Housing 40 contains a light source and a power source (not shown) electrically connected to switch 42. Turning on the light by means of switch 42 allows the archer to see the sights and line up the target under low ambient light conditions (i.e., at dusk or dawn, at night, in deep woods). While other colors may be used with the invention, a source of red light is preferred, since red light is less likely to disturb game. Furthermore, red light is convenient when the archer's eyes have become dark-adapted, since red light is visible to humans at night but does not affect the dark-adaptation of human vision as much as white light does.

Apparatus 10 may be made of any suitable materials, preferably materials that are durable and maintain their structural integrity under field conditions. Housing 12 and frame 50 may have non-reflective surfaces, colored black or some other suitable color.

Apparatus 10 is fitted to an individual archer generally as follows. After attaching mounting plate 50 to bow frame 94 with screws or bolts 56 passing through selected holes 54, the archer holds bow 90 and sights along the line defined by front sight 30 and back sight 22. If needed, he or she removes plate 50 and reattaches the plate using different holes 54 to move apparatus 10 forwards, backwards, upwards or downwards with respect to frame 94. With bolts 80*a*, 80*b* loose, the archer adjusts the lateral position of housing 12 and tightens the bolts. With wing nuts 82*a*, 82*b* loose, he adjusts the vertical position of housing 12 and tightens the nuts. By these adjustments, the archer is able to fix the optimum position of housing 12 (and front sight 30 and back sight 22) for his particular physique, stance and loosing position (that is, the position of his hand and bow string 92 relative to his face and body).

Then, to determine the windage involved in a typical shot, the archer tries out the bow by shooting at a target ("windage" means the tendency of an arrow to fly in a direction which varies horizontally from the direct line of sight in still air). Once he has found the windage by observing where arrows directed towards the target actually land, he re-adjusts the lateral position of device 10 by moving rods 18*a*, 18*b* in or out from frame 94 by an amount necessary to compensate, and tries the bow again to check whether the windage has been compensated for.

After adjusting bow sight apparatus 10, the archer simply sights directly on the target using the selected sight (allowing for variation due to wind direction and velocity if needed), and shoots. Apparatus 10 helps the archer aim and shoot accurately at the target by substantially eliminating all variables that might affect accuracy, except those variables involved in air conditions such as wind direction and velocity, and those which are due to variations in the individual's shooting technique, such as steadiness in holding the bow, consistency in the point of release of the bow string and the like, or variations in the dimensions, weight and quality of the arrows. Once the position of apparatus 10 vis à vis the bow has been adjusted to suit the individual archer, no further adjustments are needed. At the same time, apparatus 10 is simple and inexpensive to manufacture, and sturdy and dependable in use.

Apparatus 10 as illustrated in FIGS. 1 and 2 is "right-handed." That is, rods 18*a*, 18*b* extend from the right-hand side of housing 12 so that the apparatus projects outwards from the left side of bow 60 for use by a right-handed archer. It will be evident to those of ordinary skill that the apparatus may be made "left-handed" simply by attaching rods 18*a*, 18*b* to the left-hand side of housing 12.

It will be apparent to those skilled in the art that many changes and substitutions can be made to the preferred embodiment herein described without departing from the spirit and scope of the present invention as defined by the appended claims.

What is claimed is:

1. A bow sight apparatus, comprising:

a housing having an interior, a first open end and a second open end;

a front sight mounted in said interior of said housing near said first end, said front sight including a rod having a first end and a second end, said first end attached to said housing, and two sighting balls spaced along said rod at said second end; and a back sight mounted in said interior of said housing near said second end, said front and back sights being positioned in said housing so that said sights are oriented generally vertically when said apparatus is attached to a bow frame and said frame is oriented vertically for use, said two sighting balls positioned so that when said bow is aimed at a target in a first preselected range, a first ball of said two sighting balls is aligned with said back sight, and when said bow is aimed at a target in a second preselected range, a second ball of said two sighting balls is aligned with said back sight.

2. The apparatus as recited in claim 1, further comprising means for attaching said housing to said bow frame.

3. The apparatus as recited in claim 1, further comprising user-adjustable means for attaching said housing to said frame.

4. The apparatus as recited in claim 1, further comprising means for illuminating said interior of said housing.

5. The apparatus as recited in claim 4, wherein said illuminating means includes a red light attached to said housing.

6. The apparatus as recited in claim 1, wherein said housing has a non-reflective surface.

7. A bow sight apparatus, comprising:

a housing having an interior, laterally spaced side walls, a first open end and a second open end;

a first elongated rod mounted in said interior of said housing near said first end, said rod carrying at least two sighting balls, said balls spaced along said second rod and positioned so that, when said apparatus is attached to a bow and said bow is aimed at a target in a first preselected range, a first ball of said at least two sighting balls is aligned with said notch, and when said bow is aimed at a target in a second preselected range, a second ball of said at least two sighting balls is aligned with said notch; and a second elongated rod mounted in said interior of said housing near said second end, said rod having a notch sight formed therein, said first and said second rods being positioned in said housing so that, when said apparatus is used for sighting at a target, said notch and said at least one sighting ball are aligned with said target.

8. The apparatus as recited in claim 7, further comprising means for illuminating said interior of said housing.

9. The apparatus as recited in claim 7, wherein each of said side walls of said housing has at least one throughhole for admitting light into said interior.

10. The apparatus as recited in claim 7, further comprising user-operable means for illuminating said interior of said housing.

11. The apparatus as recited in claim 7, further comprising means for attaching said housing to said bow frame.

12. The apparatus as recited in claim 7, further comprising:

means for removably attaching said housing to said bow frame, said housing having a position with respect to said frame; and means for adjusting said position.

13. The apparatus as recited in claim 7, wherein said housing has a non-reflective surface.

14. The apparatus as recited in claim 7, further comprising a user-actuated red light for illuminating said interior of said housing.

15. A bow sight apparatus, comprising:

a housing having an interior, laterally spaced side walls, a first open end and a second open end;

means for removably attaching said housing to a bow frame;

a first elongated rod mounted in said interior of said housing near said first end;

a plurality of spaced-apart sighting balls on said first rod; and a second elongated rod mounted in said interior of said housing near said second end, said second rod having a notch sight formed therein, said first and said second rods being positioned in said housing so that, when said apparatus is used for sighting at a target, said notch and at least one sighting ball of said plurality of sighting balls are aligned with said target.

16. The apparatus as recited in claim 15, further comprising means for illuminating said interior of said housing.

17. The apparatus as recited in claim 15, wherein each of said side walls of said housing has at least one throughhole for admitting light into said interior.

18. The apparatus as recited in claim 15, further comprising user-actuated means for illuminating said interior of said housing.

19. The apparatus as recited in claim 15, wherein said plurality of sighting balls are positioned along said first rod so that when said apparatus is attached to a bow frame, each ball of said plurality of sighting balls is aligned with said notch for sighting at a target within a different preselected range.

20. The apparatus as recited in claim 15, wherein said attaching means further comprises:

means for adjusting said housing vertically with respect to said bow; and means for adjusting said housing laterally with respect to said bow.

* * * * *